US005171013A

United States Patent [19]

Dooley

[11] Patent Number: 5,171,013

[45] Date of Patent: * Dec. 15, 1992

[54] DETECTOR SYSTEM FOR OBJECT MOVEMENT IN A GAME

[76] Inventor: Daniel J. Dooley, 5536 Washington, Downers Grove, Ill. 60516

[ * ] Notice: The portion of the term of this patent subsequent to Oct. 10, 2006 has been disclaimed.

[21] Appl. No.: 468,536

[22] Filed: Jan. 23, 1990

[51] Int. Cl.[5] ..... A63F 9/22; A63F 9/24

[52] U.S. Cl. ..... 273/85 G; 273/2; 273/437; 273/108; 273/118 A; 273/DIG. 28; 273/185 R

[58] Field of Search ..... 273/87 R, 87 A, 87 B, 273/87 H, 185 A, 185 B, 186 R, 185 R, 179 A, 179 E, 2, 3 R, 3 A, 37, 54 R, 54 C, 47, 48, 371; 250/206.1, 222.1

[56] References Cited

U.S. PATENT DOCUMENTS 4,150,825 5/1979 Wilson ..... 273/185
4,180,726 12/1979 DeCrescent ..... 273/26 R
4,563,005 1/1986 Hand et al. ..... 273/185 R
4,652,121 3/1987 Ito et al. ..... 273/26 B
4,872,687 10/1989 Dooley ..... 273/185 R

*Primary Examiner*—Vincent Millin
*Assistant Examiner*—Jessica J. Harrison
*Attorney, Agent, or Firm*—Gregory B. Beggs

[57] ABSTRACT

A method and system is provided which is particularly designed for board, lane or field games in which balls, pucks or the like are rolled, slid or otherwise propelled by a player over a horizonal support surface. Radiant energy emitters and detectors are providing along opposite sides of the support surface to detect crossings by the of detection lines including a first pair of lines perpendicular to a central reference line midway between such opposite side and a second pair of lines crossing the first pair of lines at points in the central reference line. Signals are developed which are applied to display a representation of the object which moves in a path and at a speed determined by the movement of the propelled object. Crossings of additional detection lines are detected to detect and display changes in speed and curvatures in the path of movement of the propelled object.

18 Claims, 4 Drawing Sheets

DETECTOR SYSTEM FOR OBJECT MOVEMENT IN A GAME

FIELD OF THE INVENTION

This invention relates to sports or games generally and more specifically to board, lane or field games wherein objects are rolled or slid over a horizontal plane.

BACKGROUND OF THE INVENTION

Games involving rolling or sliding objects usually involve a player hitting or rolling the ball or sliding object towards a hole or some target. For instance, bowling requires a person to aim a bowling ball down a lane towards a group of pins standing at the far end of the lane. There typically are gutters on both sides of the lane that catch an errant shot and prevent the ball from contacting any pins. The object of the game is to have the bowling ball knock down as many pins as possible. An advanced technique of putting a spin on the bowling ball so that it curves into the pins allows better bowlers to knock down more pins. Some examples of bowling games are:

(a) Full scale bowling usually entails a specially oiled wooden floor of twenty five feet or more in length. There usually are ten pins, each over a foot tall weighing several pounds. A bowling ball weighing up to 16 pounds is used. The pins that are knocked down have to be cleared and reset into position. The ball has to be returned to the bowler.

(b) Table top versions of bowling may use a scaled down lane, pins and balls. The ball still has to be returned, the pins cleared and reset.

(c) Another table top version uses a sliding disc with contact switches embedded in the lane underneath pins that fold-down from above the lane. There is enough clearance between the pins and the switches for the disc to slide between. When the disc contacts a switch certain pins fold up which relates to knocking down pins in regulation bowling. The bowler does not benefit from spinning the disc. The disc is returned to the bowler by bouncing off a rubber bumper located at the end of the lane.

(d) Video versions of bowling typically display the lane, pins and ball on the monitor. The player uses joy sticks and switches to control the speed, direction and spin of the ball. One variation of the joy stick is a captured ball embedded in the console. When this ball is spun, detectors inside the console encode the rotational movement which is converted by a microprocessor into projected ball movement on the screen.

Each of these devices have certain limitations. The full scale bowling as described in (a) above requires a lot of space and a sizeable monetary expense for the equipment. Repairs and maintenance for the pin setting and ball return mechanisms and the lane upkeep are needed constantly.

The scaled down bowling game as described in (b) above requires that the pins be cleared and set. In most cases, the way that the pins react to the ball striking them does not duplicate the way it happens in the full scale bowling version.

The sliding disc table top version as described in (c) above limits the problems of pin clearing and setting. However, there are many moving parts which leads to constant breakdown from wear and tear. The aiming and sliding of the disc does not simulate the motion of throwing the full scale bowling ball. Spinning, which is used by experienced bowlers in (a) and (b), does not come into play when using a disc. A skilled bowler of full scale bowling is not necessarily a skilled disc bowler.

Video versions as described in (d) above alleviate the problems of pin clearing and setting. These are handled with the game software. Controlling the ball speed, direction and spin with joy sticks, spinning balls and switches does not simulate the motion of throwing the full scale bowling ball. Eye-hand coordination and finger dexterity are required to be skillful with joy sticks, spinning balls and switches. The rhythmic, pendulum swing of a typical bowler does not come into play at all. A skilled bowler of full scale bowling is not necessarily a skilled manipulator of joy sticks, spinning ball and switches.

In applicant's U.S. Pat. No. 4,872,687 a sensor arrangement is disclosed which effectively measures variations in roll patterns from a reference line for games such as golf, pool or the like involving movement across a horizontal plane. The ball or object generally, although not necessarily, starts at a point along the reference line.

In certain variations of these and other games it is often desired that the ball or object start from a variety of positions. Moreover, in many of these variations the moving object may travel in a path which is not a straight, e.g. a "hooked" path as in bowling.

It is a general object of the present invention to provide a movement detection system that operates independent of the starting point for the object moving.

It is a related object of the invention to provide a detection system that senses movement in a path that may be other than a straight line.

It is a more specific object of the invention to provide a game system that measures object paths without moving parts or complicated mechanical or electromechanical sensors.

THE PRESENT INVENTION

These and other objects and advantages are provided in an interface that would allow any game that propels a rolling or sliding object towards a target to be merged with a video display while still using the typical motions and devices to propel the object. Means are provided to accurately determine the speed and direction of the propelled object accurately with a non-intrusive means. Key components involved in determining direction are the position of the propelled object in relation to the center position, the angle of the propelled object's path and any curving nature of the propelled object's path. Path detection is achieved by pairs of optical detectors arranged for scanning the object plane. Two pair of such detectors detect straight line movement independent of origin, while a third pair of such detectors measures curved path movement.

The preferred embodiment of the invention illustrates the application of the detection means as used in a bowling game. One variation of the preferred embodiment is the disc sliding bowling. This version does not require the determination of any curving component of the disc's path.

Another version of the preferred embodiment incorporates a shortened full-scale bowling lane. The bowler uses a standard bowling ball. Instead of actual bowling pins being at the end of the lane, there is a video monitor that would have displayed a graphical representation of the bowling pins. At the end of the bowling lane where actual pins would normally be positioned, there is a sensor housing. It is large enough for an actual bowling ball to roll through and it has the sensors positioned at ½ the height of the actual bowling ball.

The invention is readily applied to games using a cue ball as the propelled object, such as pocket billiards, snooker, billiards, bumper pool, and many other varieties. A regular cue ball and cue stick is preferably used in order to retain the "feel" of the game. A short runway covered with felt serves as the surface where the cue ball is positioned to be struck by the cue. A video monitor is placed just above and beyond the sensor housing. The cue ball is aligned with a spot on the video monitor and it is propelled towards the video monitor, rolling through the sensor housing. A return chute is positioned at the end of the sensor housing which returns the cue ball to the pool player. The speed, direction and path information is detected, calculated and outputted to video control circuitry.

The information may be utilized in a variety of ways. In the preferred embodiment, the video control circuitry translates it to a display of the cue ball on the screen following the same relative path position, movement and speed. The displayed, moving ball continues until it hits a bumper, another pool ball or goes into a pocket, depending upon the design of video displayed game.

Skee ball is another game that readily adapts to the application of the invention. Skee ball is basically a game where a ball is rolled toward a tilted target of circular containers, smaller containers inside larger ones until the final centered container is not much larger than the diameter of the ball. The object is to get the ball to roll up a ramp into the middle small containers which score more points than the larger containers.

A skee ball game incorporating the application of the invention could have as one version a shortened ramp similar to a skee ball ramp. Instead of having the actual circular targets, there is a video monitor where the skee ball circular targets is graphically represented. The skee ball rolls towards the video monitor and passes through a sensor housing. The ball movement is detected, analyzed and converted to a form acceptable by the video control circuitry, which then projects a moving ball onto the video monitor.

Shuffleboard is another game that readily adapts to the application of the invention. Shuffleboard is a game in which a disc-like object is propelled from one end of a lane to the other (a length of approximately 20 feet) with a pushing motion on a stick that cradles the disc. A shorter, table version using hand-propelled metal discs is also popular. The object is to have the disc push an opponent's discs off of designated point areas and or have the propelled disc stop inside a designated point area.

The shuffleboard game that has the invention incorporated into it could have as versions a full scale version or some scaled table top version. In the full scale version, a flooring representing the shuffleboard lane is used but it is not as long as the typical shuffleboard lane. There is only one end with designated point areas, and this end has a video monitor present and a sensor housing that allows the sliding disc to travel through. The scaled table version is similar but the lane is elevated and a smaller disc and shuffleboard stick are used. In all of these games a suitable ball or object return mechanism can be provided by one skilled in the art.

The variety of games possible with the present invention is endless. Marbles is another example of a game that can use the application of the invention.

DESCRIPTION OF A PREFERRED EMBODIMENT

Figure 1:
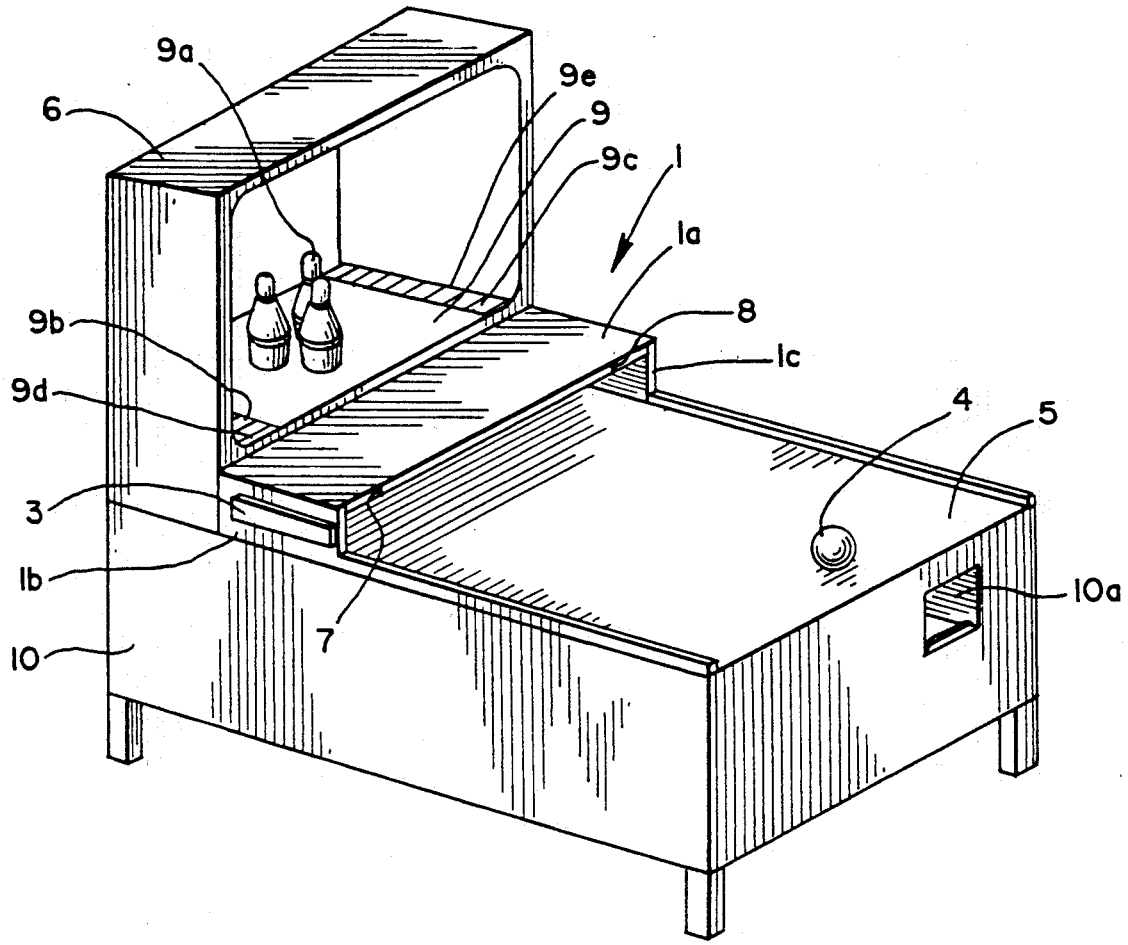
FIG. 1 is a perspective view of a game constructed in accordance with the invention, the game being illustrated in use with a bowling ball.

Referring to FIG. 1, reference number 1 designates the sensor housing. The top, left wall and right wall of the enclosure 1 are respectively designated 1*a*, 1*b* and 1*c*. In the right wall 1*c* of the sensor housing 1 are located the infrared emitters and detectors 2 and in the left wall 1*b* are located the corresponding infrared detectors and emitters 3. A bowling ball 4 is shown at the usual starting area on the bowling surface 5. Above and behind the sensor housing 1 is a video monitor 6. On the top wall of the sensor housing 1*a* are point of references 7 and 8. Presented graphically on the video monitor 6 is a representation of a bowling alley 9, which includes an assorted number of bowling pins 9*a*, a left gutter 9*b* and right gutter 9*c* and the left edge of the bowling alley 9*d* and the right edge of the bowling alley 9*e*. Point of reference 7 aligns with the left edge of the bowling alley display 9*d* and point of reference 8 aligns with the right edge of the bowling alley 9*e*. The bowling surface 5, the sensor housing 1 and the video monitor 6 are attached to the top of the game cabinetry 10. On the bowling surface 5 between the sensor housing 1 and the base of the video monitor 6, there is an opening into the game cabinetry 10. After a bowling ball 4 has rolled through the sensor housing 1 it falls into the opening onto a chute that is angled from back to front. At the end of the game cabinetry 10 farthest from the video monitor 6 is an opening 10*a* where the chute ends and the bowling ball 4 returns.

Figure 2:
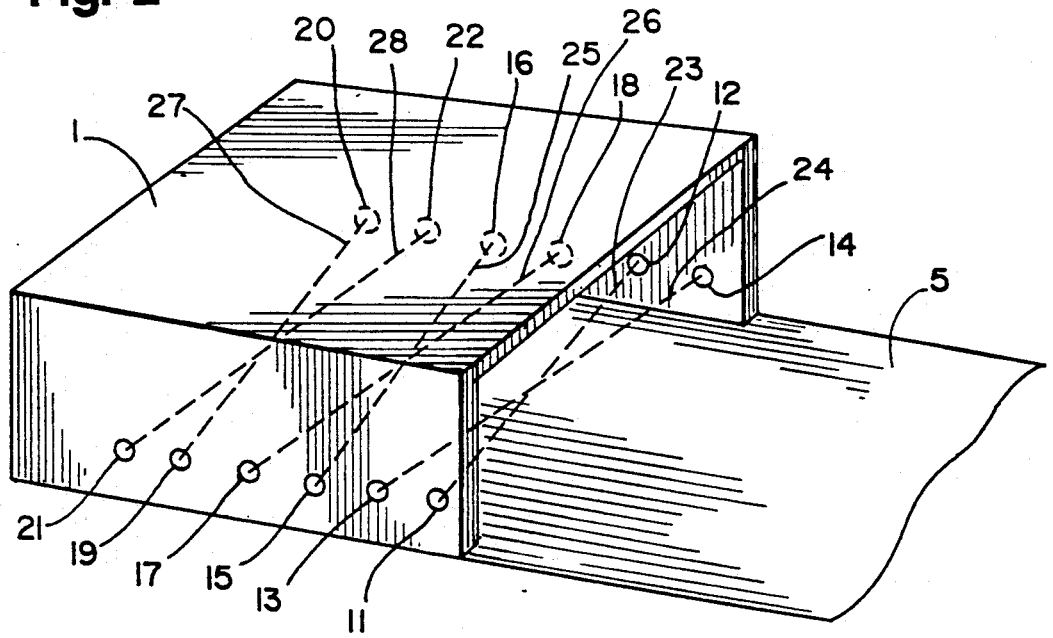
FIG. 2 is an enlarged perspective view of the sensor enclosure portion of FIG. 1 containing the infrared sensor positioning along with an illustration of the associated optical beams.
Figure 3:
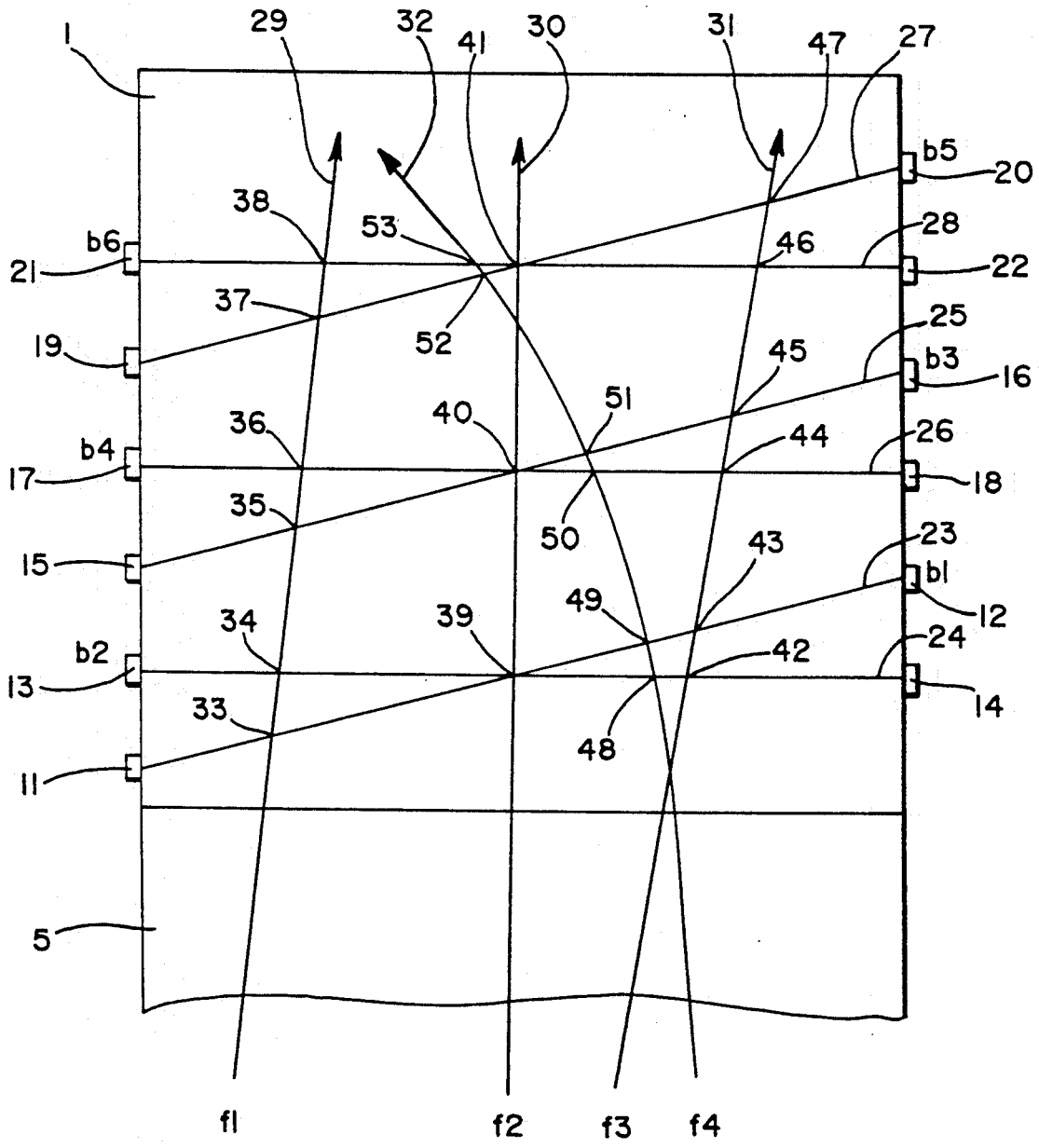
FIG. 3 is an overhead view of four typical paths of a bowling ball inside the sensor housing and how these paths intersect the sensor beams.

FIGS. 2 and 3 show the positioning of the optical sensors within the sensor housing 1. The sensors are all positioned above the bowling surface 5 by ½ the diameter of the bowling ball 4. Beam 24 comprises the light traveling from the infrared emitter 14 across to infrared detector 13. Beam 26 comprises the light traveling from the infrared emitter 18 across to infrared detector 17. Beam comprises the light traveling from the infrared emitter 22 across to infrared detector 21. As the illustration shows, beam 24, beam 26 and beam 28 are parallel to one another. Beam 23 comprises the light traveling from the infrared emitter 11 across to infrared detector 12. Beam 23 bisects beam 24 at its mid-point and extends angularly with respect thereto. Beam 25 comprises the light traveling from the infrared emitter 15 across to infrared detector 16. Beam 25 bisects beam 26 at its mid-point and extends angularly with respect thereto. Beam 27 comprises the light traveling from the infrared emitter 19 across to infrared detector 20. Beam 27 bisects beam 28 at its mid-point and extends angularly with respect thereto. By positioning only emitters next to detectors lessens any possible interference from other beams. The object path or trajectory is determined in three steps using multiple parallel reference beams and corresponding intersecting beams at acute angles. First it is determined whether the reference line is broken to the right or left of center. Then the point of actual intersection of the reference is determined by measuring deviation from the center. Finally the points of intersection of the respective reference lines are compared to define a line of movement for the ball. In addition, speed and surface resistance can be measured.

If the bowling ball 4 has broken the plane of beam 23 before it has broken the plane of beam 24 then the bowling ball 4 is traveling left of the mid-point of beam 24. If the bowling ball 4 has broken the plane of beam 24 before it has broken the plane of beam 23 then the bowling ball 4 is traveling right of the mid-point of beam 24. If the bowling ball 4 has broken the plane of beam 23 and beam 24 at precisely the same time, then the bowling ball 4 is traveling on the mid-point of beam 24. By utilizing the ratio of the time the bowling ball 4 takes to travel from beam 23 to beam 26 and the time the bowling ball 4 takes to travel between beam 24 and beam 26 the invention can ascertain the amount of distance that the bowling ball 4 has deviated from the mid-point of beam 24.

If the bowling ball 4 has broken the plane of beam 25 before it has broken the plane of beam 26 then the bowling ball 4 is traveling left of the mid-point of beam 26. If the bowling ball 4 has broken the plane of beam 26 before it has broken the plane of beam 25 then the bowling ball 4 is traveling right of the mid-point of beam 26. If the bowling ball 4 has broken the plane of beam 25 and beam 26 at precisely the same time, then the bowling ball 4 is traveling on the mid-point of beam 26. By utilizing the ratio of the time the bowling ball 4 takes to travel from beam 24 to beam 25 and the time the bowling ball 4 takes to travel between beam 24 and beam 26 the invention can ascertain the amount of distance that the bowling ball 4 has deviated from the mid-point of beam 26.

If the bowling ball 4 has broken the plane of beam 27 before it has broken the plane of beam 28 then the bowling ball 4 is traveling left of the mid-point of beam 28. If the bowling ball 4 has broken the plane of beam 28 before it has broken the plane of beam 27 then the bowling ball 4 is traveling right of the mid-point of beam 28. If the bowling ball 4 has broken the plane of beam 27 and beam 28 at precisely the same time, then the bowling ball 4 is traveling on the mid-point of beam 28. By utilizing the ratio of the time the bowling ball 4 takes to travel from beam 26 to beam 27 and the time the bowling ball 4 takes to travel between beam 26 and beam 28 the invention can ascertain the amount of distance that the bowling ball 4 has deviated from the mid-point of beam 28.

Having determined the points of intersection of the beams 24, 26 and 28, the path of movement is defined. By utilizing pairs of infrared emitters and detectors the movement of a bowling ball 4 that is rolled by a bowler can be detected without any contact between ball and sensor and without the use of any foreign substance.

By ascertaining the time it takes the bowling ball 4 to travel between the parallel beams 24 and 26, or the parallel beams 26 and 28, and knowing the angle of the path relative to those beams, the invention translates this time into the speed of the moving bowling ball 4. By comparing the time it takes the bowling ball 4 to travel between the parallel beams 24 and 26 to the time it takes the bowling ball 4 to travel between the parallel beams 26 and 28, the invention can ascertain the rate at which the bowling ball 4 is slowing down, which is a measure of surface friction or resistance.

The amount of distance that the bowling ball 4 has deviated from the mid-point of beam 28, which is the parallel beam farthest from the starting point in the preferred embodiment, is used as the initial columnar position of the graphic presentation of the bowling ball on the video monitor 6.

In the preferred embodiment, by comparing the amount of distance that the bowling ball 4 has deviated from the mid-point of beam 24 with the amount of distance that the bowling ball 4 has deviated from the mid-point of beam 26 and with the amount of distance that the bowling ball 4 has deviated from the mid-point of beam 28, the invention can determine the angle and curvature of the bowling ball 4 movement.

In a variation of the invention, one in which the moving projectile would be expected to move in a straight path, beams 23 and 24 would not be necessary. The sensor housing could then be smaller. A pool game using a rolling cue ball or a bowling game using a sliding disc could fall under this variation.

FIG. 3 is an overhead view showing the outline of the sensor housing 1. It illustrates how a ball following a path f1 29 starting left of center and angling toward the right and a ball hit straight on a path f2 30 and a ball's path f3 31 that is hit right of center and is angling toward the right and a ball's path f4 32 that is starting right of center and is curving left over center each intersect the six beams, 23, 24, 25, 26, 27 and 28. Path f1 29 intersects beam 23 at point 33 prior to intersecting beam 24 at point 34, which indicates that it is on a path left of center. It then intersects beam 25 at point 35 prior to intersecting beam 26 at point 36, which indicates that it is continuing on a path left of center. It then intersects beam 27 at point 37 prior to intersecting beam 28 at point 38, which indicates that it is continuing on a path left of center. Path f2 30 intersects beam 23 and 24 at the same point 39 and intersects beams 25 and 26 at the same point 40 and intersects beams 27 and 28 at the same point 41, which indicates that it is a straight path down the center. Path f3 31 intersects beam 24 at point 42 prior to intersecting beam 23 at point 43, which indicates that it is on a path right of center. It then intersects beam 26 at point 44 prior to intersecting beam 25 at point 45, which indicates that it is continuing on a path right of center. It then intersects beam 28 at point 46 prior to intersecting beam 27 at point 47, which indicates that it is continuing on a path right of center. Path f4 32 intersects beam 24 at point 48 prior to intersecting beam 23 at point 49, which indicates that it is on a path right of center. It then intersects beam 26 at point 50 prior to intersecting beam 25 at point 51, which indicates that it is continuing on a path right of center. It then intersects beam 27 at point 52 prior to intersecting beam 28 at point 53 which indicates that it has crossed over on a path left of center.

Figure 4:
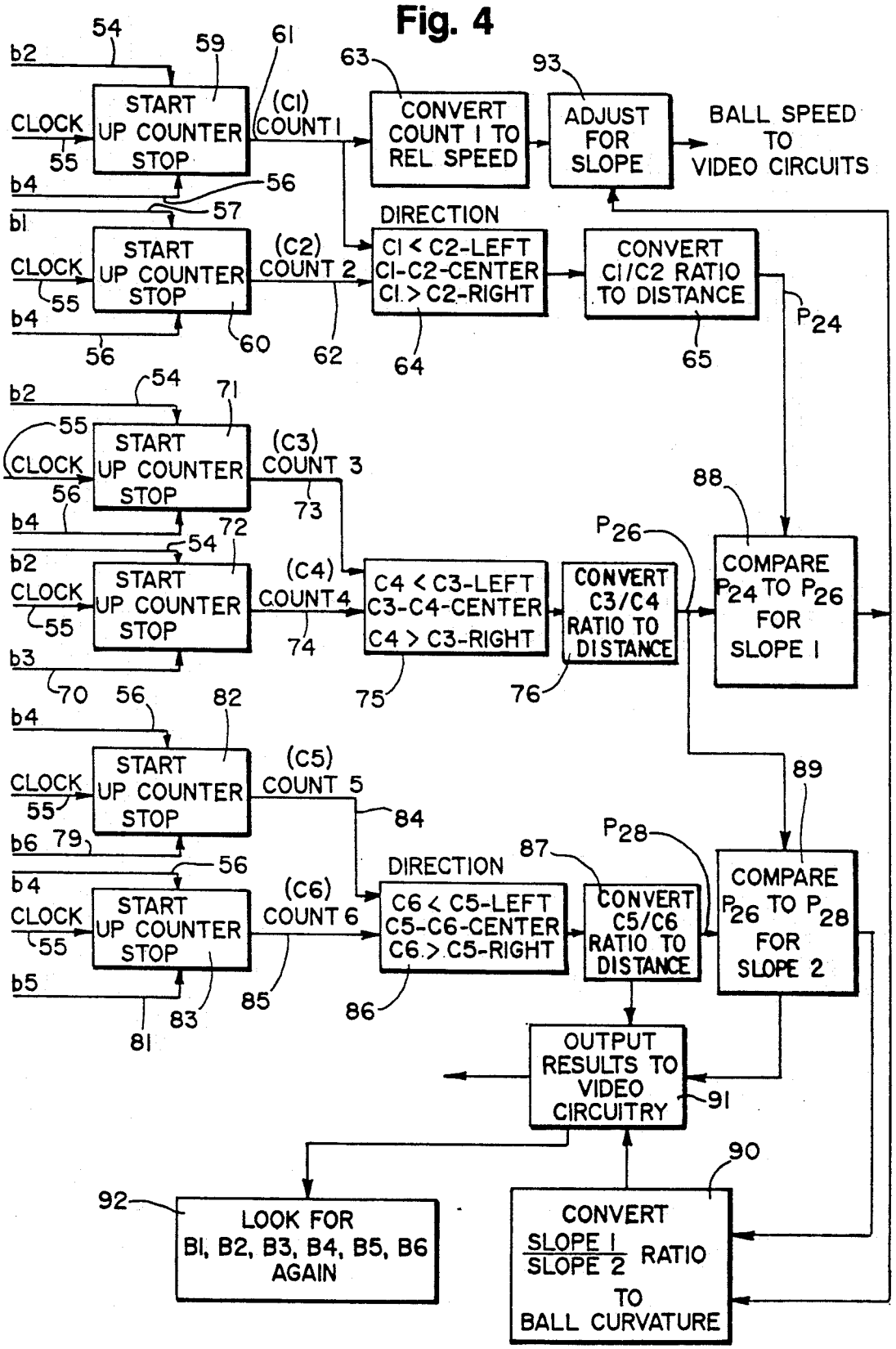
FIG. 4 is a flow chart/block diagram depicting how the sensor output gets converted to distance, direction distance, slope of ball path, and ball path curvature information and output to the video control circuitry.

FIG. 4 is a flow chart illustrating how the sensor information from infrared detectors 12, 13, 16, 17, 20 and 21 (signals b1 57, b2 54, b3 70, b4 56, b5 81 and b6 79 respectively) is converted into a final output. A clock input 55 increments six up counters 59, 60, 71, 72, 82 and 83 to create count C1 61, C2 62, C3 73, C4 74, C5 84 and C6 85 respectively. The C1 Count 61, is the result of detector signal b2 54 starting the up counter 59 and b4 56 stopping same. C1 61 is then converted to a number at 63 relative to the speed of the bowling ball 4. The number 63 is adjusted for the slope of the object path 88 to obtain object speed at 93. The number 63 is then outputted to the video control circuitry 91. The C2 Count 62 is the result of b1 57 starting the up counter 60 and b4 56 stopping same. C2 62 is then compared to C1 61 to arrive at the position relating to center (direction), as indicated at 64. The ratio of C1 61 over C2 62 is then converted to a direction distance number 65 relative to the distance of the ball's path left or right of center. The C3 Count 73, is the result of detector signal b2 54 starting the up counter 71 and b4 56 stopping same. The C4 Count 74 is the result of b2 54 starting the up counter 72 and b3 70 stopping same. C4 74 is then compared to C3 73 to arrive at the position relating to center (direction), as indicated at 75. The ratio of C3 73 over C4 74 is then converted to a direction distance number 76 relative to the distance of the ball's path left or right of center. The direction distance number 65 is then compared with the direction distance number 76 at 88 to come up with the slope of the ball path between beam 23, 24 and beam 26, 25. The C5 Count 84, is the result of detector signal b4 56 starting the up counter 82 and b6 79 stopping same. The C6 Count 85 is the result of b4 56 starting the up counter 83 and b5 81 stopping same. C6 85 is then compared to C5 84 to arrive at the position relating to center (direction), as indicated at 86. The ratio of C5 84 over C6 85 is then converted to a direction distance number 87 relative to the distance of the ball's path left or right of center. The direction distance number 76 is then outputted to the video control circuitry 91. The direction distance number 76 is then compared with the direction distance number 87 at 89 to come up with the slope of the ball path between beams 26, 25 and beams 28, 27. The slope 89 is then outputted to the video control circuitry 91. The slope 88 is then compared with the slope 89 to come up with a number representing the ball path curvature 90. The ball path curvature number 90 is then outputted to the video control circuitry 91. After the video control circuity receives all the output 91, the activity then reverts back to the six up counters 59, 60, 71, 72, 82 and 83.

Figure 5:
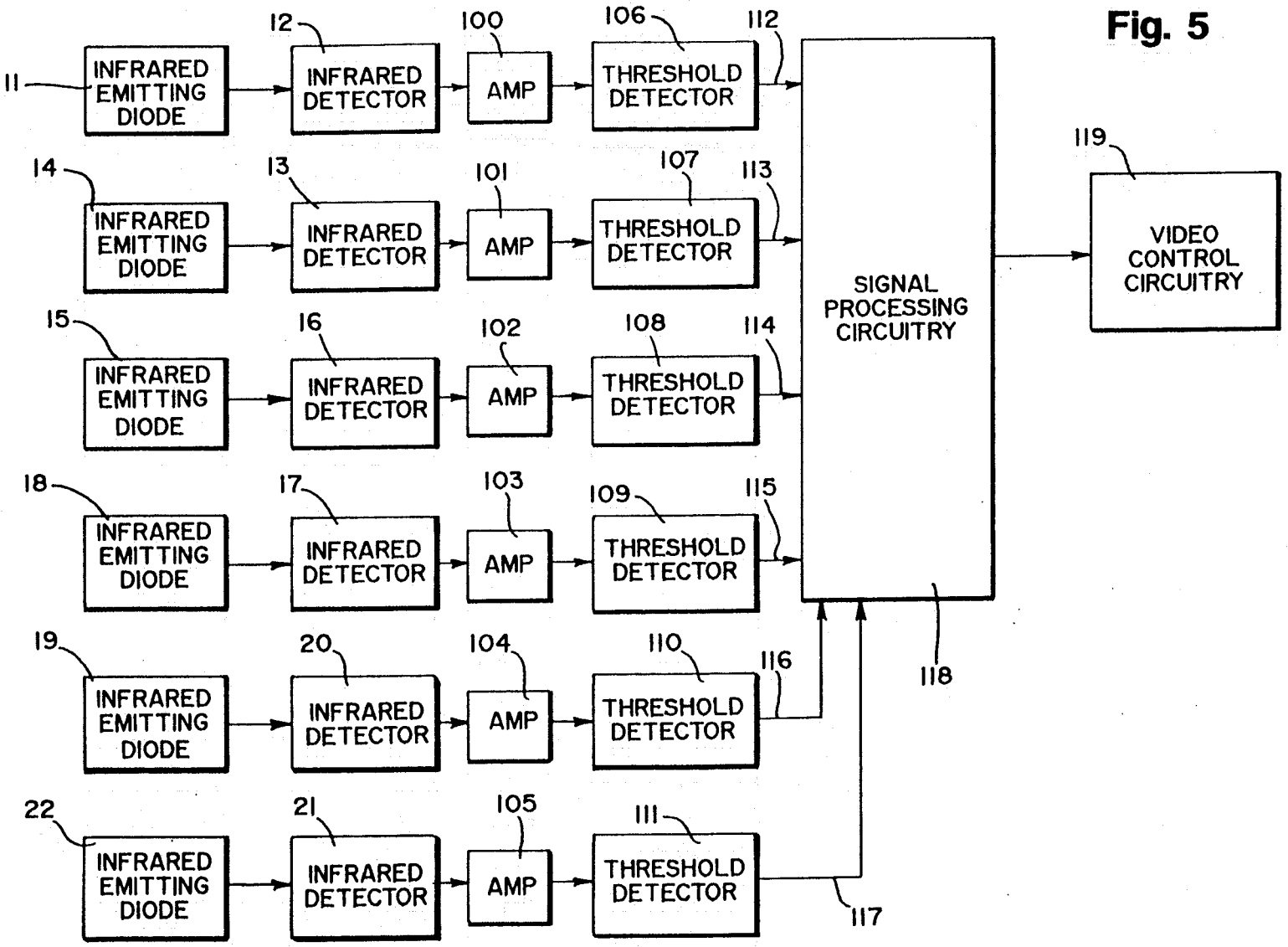
FIG. 5 is a block diagram of the circuitry of the game shown in FIG. 1.

FIG. 5 is a block diagram of the circuitry of the invention. The principal element of the circuit is a signal processing circuit 118, which is preferably a microprocessor. Inputs 112, 113, 114, 115, 116 and 117 to the processor 118 come from each of the beam detection channels described below.

Turning first to the beam detection channels, the infrared emitting diode 11 beams radiation in the direction of infrared detector 12. As long as the radiation is not interrupted, the input 112 to the signal processing circuitry 118 is set at 0. If the radiation is interrupted by a moving bowling ball 4, the infrared detector 12 output falls towards zero volts. This change of voltage is inverted and amplified in amplifier 100. The altered voltage is then compared in a threshold detector 106 with a threshold voltage set at a trigger point and, if the altered voltage is greater than the trigger point voltage, then an input 112 of 5 volts is delivered to the signal processing circuitry 118. Similarly, the infrared emitting diode 14 beams radiation in the direction of infrared detector 13. As long as the radiation is not interrupted, the input 113 to the signal processing circuitry 118 is set at 0. If the radiation is interrupted by a moving bowling ball 4, the infrared detector 13 output falls towards zero volts. This change of voltage is inverted and amplified in amplifier 101. The altered voltage is then compared in a threshold detector 107 with a threshold voltage set at a trigger point and, if the altered voltage is greater than the trigger point voltage, then an input 113 of 5 volts is delivered to the signal processing circuitry 118. Similarly, the infrared emitting diode 15 beams radiation in the direction of infrared detector 16. As long as the radiation is not interrupted, the input 114 to the signal processing circuitry 118 is set at 0. If the radiation is interrupted by a moving bowling ball 4, the infrared detector 16 output falls towards zero volts. This change of voltage is inverted and amplified in amplifier 102. The altered voltage is then compared in a threshold detector 108 with a threshold voltage set at a trigger point and, if the altered voltage is greater than the trigger point voltage, then an input 114 of 5 volts is delivered to the signal processing circuitry 118. Similarly, the infrared emitting diode 18 beams radiation in the direction of infrared detector 17. As long as the radiation is not interrupted, the input 115 to the signal processing circuitry 118 is set at 0. If the radiation is interrupted by a moving bowling ball 4, the infrared detector 17 output falls towards zero volts. This change of voltage is inverted and amplified in amplifier 103. The altered voltage is then compared in a threshold detector 109 with a threshold voltage set at a trigger point and, if the altered voltage is greater than the trigger point voltage, then an input 115 of 5 volts is delivered to the signal processing circuitry 118. Similarly, the infrared emitting diode 19 beams radiation in the direction of infrared detector 20. As long as the radiation is not interrupted, the input 116 to the signal processing circuitry 118 is set at 0. If the radiation is interrupted by a moving bowling ball 4, the infrared detector 20 output falls towards zero volts. This change of voltage is inverted and amplified in amplifier 104. The altered voltage is then compared in a threshold detector 110 with a threshold voltage set at a trigger point and, if the altered voltage is greater than the trigger point voltage, then an input 116 of 5 volts is delivered to the signal processing circuitry 118. Similarly, the infrared emitting diode 22 beams radiation in the direction of infrared detector 21. As long as the radiation is not interrupted, the input 117 to the signal processing circuitry 118 is set at 0. If the radiation is interrupted by a moving bowling ball 4, the infrared detector 21 output falls towards zero volts. This change of voltage is inverted and amplified in amplifier 105. The altered voltage is then compared in a threshold detector 111 with a threshold voltage set at a trigger point and, if the altered voltage is greater than the trigger point voltage, then an input 117 of 5 volts is delivered to the signal processing circuitry 118.

The signal processing circuitry 118 in a variation of the invention, one in which the moving projectile would be expected to move in a straight path, one in which beams 23 and 24 would not be necessary, is an Intel Microprocessor chip, D8749, containing the following hexadecimal machine code:

| | | | | | | | | | | | | | | | |
|---|---|---|---|---|---|---|---|---|---|---|---|---|---|---|---|
| 9A | FF | 99 | FC | C5 | 27 | B8 | 7F | A0 | E8 | 08 | 62 | 16 | 0E | 23 | FF |
| 02 | 00 | 14 | 25 | F9 | C6 | 1B | 54 | 8D | 04 | 12 | 54 | B6 | 14 | A3 | 54 |
| 1E | 54 | 5B | 04 | 12 | C5 | 27 | 99 | FC | B8 | 07 | A0 | E8 | 2B | 09 | 52 |
| 3C | 86 | 2E | 14 | 94 | 09 | 52 | 4A | 16 | A0 | 04 | 35 | 14 | 94 | 16 | A0 |
| 86 | 3E | 14 | 8B | B8 | 52 | B0 | FF | B8 | 50 | FB | A0 | 18 | FC | A0 | 09 |
| 72 | 60 | 92 | 66 | 16 | A0 | 04 | 57 | BD | FF | B9 | 08 | 14 | 8B | 09 | 59 |
| 16 | A0 | C6 | 6C | 99 | FC | 0A | B8 | 59 | A0 | 42 | C8 | A0 | B8 | 56 | FD |
| A0 | C8 | FC | A0 | C8 | FB | A0 | 42 | 03 | EC | E6 | A0 | 83 | 99 | FC | 0A |
| AC | 42 | AB | 89 | 02 | 83 | 45 | 89 | 01 | 99 | FE | 89 | 02 | 27 | 62 | 16 |
| 9F | 83 | B9 | FF | 83 | 24 | 61 | B8 | 07 | F0 | AF | C8 | F0 | AE | BA | 24 |
| BB | 9F | B9 | 00 | B8 | 00 | FF | 37 | 03 | 01 | AF | FE | 37 | 13 | 00 | AE |
| FB | 6F | AB | FA | 7E | AA | E6 | DA | 14 | D3 | 97 | FB | F7 | AB | FA | F7 |
| AA | EC | BE | 04 | E8 | F9 | F7 | A9 | F8 | F7 | A8 | 83 | 14 | D3 | FB | C5 |
| 6F | D5 | AB | FA | C5 | 7E | D5 | AA | 04 | C8 | F9 | AD | F8 | AC | 27 | AA |
| AB | FD | 03 | 00 | AB | FC | 13 | F6 | AA | BC | 04 | 00 | 00 | 00 | 00 | 00 |
| 00 | 00 | 97 | FA | 67 | AA | FB | 67 | AB | EC | 00 | FB | 03 | 26 | AB | FA |
| 13 | 01 | AA | F8 | AE | F9 | AF | 27 | AD | AC | B8 | 30 | A0 | 18 | A0 | 18 |
| A0 | 18 | A0 | B9 | 0C | 34 | 26 | 83 | 27 | FA | 67 | AA | FB | 67 | AB | 00 |
| 00 | 00 | F6 | 4E | 97 | FF | F7 | AF | FE | F7 | AE | FD | F7 | AD | FC | F7 |
| AC | E9 | 4C | B8 | 30 | B9 | 40 | F0 | A1 | 18 | 19 | F0 | A1 | 83 | 24 | 26 |
| B8 | 33 | F0 | 6F | A0 | C8 | F0 | 7E | A0 | C8 | F0 | 7D | A0 | C8 | F0 | 7C |
| A0 | 24 | 32 | FE | 03 | 6E | E6 | 76 | 97 | FE | 67 | AE | FF | 67 | AF | D5 |
| B8 | 2F | B0 | FF | BC | 0F | 04 | A5 | D5 | B8 | 2F | B0 | 00 | BC | 10 | 04 |
| A5 | B8 | 2F | F0 | C5 | C6 | 8C | 97 | FF | F7 | AF | FE | F7 | AE | FD | B8 |
| 1A | C6 | A2 | FB | A0 | 18 | FC | A0 | 18 | 18 | 18 | FE | A0 | 18 | FF | A0 |
| B8 | 04 | 24 | B1 | FE | A0 | 18 | FF | A0 | 18 | 18 | 18 | FB | A0 | 18 | FC |
| A0 | B8 | 07 | D5 | 27 | A8 | A9 | FB | 37 | 03 | 01 | AB | FA | 37 | 13 | 00 |
| AA | BC | 09 | FF | 6B | AF | FE | 7A | AE | E6 | D6 | 14 | D3 | 97 | FF | F7 |
| AF | FE | F7 | AE | EC | C1 | 24 | E6 | 14 | D3 | FF | C5 | 60 | C8 | D5 | AF |
| FE | C5 | 70 | 18 | D5 | AE | 24 | CB | 00 | F9 | 03 | 39 | A9 | BD | 18 | BE |
| 00 | BA | 00 | BB | 00 | BC | 00 | 97 | F9 | F7 | A9 | FE | F7 | AE | 03 | C7 |
| 00 | E6 | 02 | AE | FC | F7 | AC | FB | F7 | AB | FA | F7 | AA | ED | 1C | B8 |
| 02 | 97 | FA | 67 | AA | FB | 67 | AB | FC | 67 | AC | E8 | 0F | 83 | 24 | F5 |
| C5 | B8 | 56 | F0 | 37 | AD | 34 | 7F | B8 | 56 | F0 | C6 | 31 | FB | 37 | 97 |
| 67 | 44 | 36 | FB | 97 | 67 | 43 | 80 | B8 | 60 | A0 | C5 | B8 | 5C | F0 | AC |
| C8 | F0 | AB | B8 | 52 | F0 | AD | 34 | 7F | B8 | 52 | F0 | C6 | 52 | FB | 37 |
| 97 | 67 | 44 | 57 | FB | 97 | 67 | 43 | 80 | B8 | 61 | A0 | 83 | D5 | B8 | 60 |
| F0 | 54 | 6F | 18 | F0 | 54 | 6F | B8 | 40 | F0 | 54 | 6F | 18 | F0 | 54 | 6F |
| 83 | B9 | 08 | 97 | F7 | F6 | 7B | 98 | FC | 54 | 86 | 44 | 7F | 98 | FD | 54 |
| 86 | 88 | FF | 54 | 86 | E9 | 71 | 83 | BB | 0A | EB | 88 | 83 | 00 | 00 | 27 |
| 54 | 6F | 27 | 54 | 6F | 27 | 54 | 6F | 27 | 54 | 6F | 83 | F0 | AF | C8 | F0 |
| AE | F1 | AC | C9 | F1 | AB | 83 | B8 | 5C | FF | A0 | C8 | FE | A0 | 18 | 83 |
| F0 | 6A | A0 | C8 | F0 | 79 | A0 | 83 | B8 | 56 | F0 | C6 | C2 | C8 | B9 | 59 |
| 54 | 9A | 44 | C8 | B8 | 59 | B9 | 55 | 54 | 9A | B9 | 51 | F1 | 37 | 03 | 01 |
| AA | C9 | F1 | 37 | 13 | 00 | A9 | B8 | 52 | F0 | C6 | DF | 54 | A5 | 54 | AE |
| 83 | 54 | A5 | B8 | 07 | 54 | AE | B8 | 04 | 54 | AE | 83 | | | | |

The foregoing code is used by the microprocessor to assimilate all the inputs and convert them to an output form (in the general manner shown and described above in connection with FIG. 4), which is sent to video control circuitry 119 (which may include a microprocessor or be an entire computer system).

A variation of the invention is a device that uses a similar sensor housing and sensor arrangement. The output from the sensors however, are sent via cable to an input port (a joy stick port, for instance) of a personal computer or a video game system (such as ones built by Nintendo or Sega). The personal computer or video game system has running software that makes all the necessary computations and calculations necessary to come up with distance and direction. For personal computers or video game systems that lack an adequate means to time the sensor information in a precise and accurate fashion, electronics would be available on the invention that would convert the sensor information to distance and direction data and in turn would convey this data to the personal computer or video game system via a serial link.

Another variation of the invention would be an arcade-style machine that would allow a person to play the game after paying money. In essence the arcade-like machine would incorporate the same positioning and use of the sensors as the other variations of the invention did.

Another variation of the invention would be the use of pressure-sensitive strips, momentary contact-like switches or upwardly pointing light emitters/detectors, laid across the width of the sensor housing in much the same pattern as the optical beams but positioned on top of or imbedded into the surface. When the propelled ball or sliding disc rolls across the strips, switches or emitters/detectors, information corresponding to the optical sensors' output used in the preferred embodiment of the invention would be attained.

I claim as my invention:

1. A method for obtaining information regarding the movement of an object in a horizontal path which is in a region along a horizontal reference plane and which is between side boundaries of said region, comprising:

establishing first and second horizontal detection lines in generally spaced, parallel relation to each other across said reference plane at locations to be intersected by said object when moving in said path;

establishing third and fourth horizontal detection lines across said plane which intersect said first and second lines, respectively, at acute angles and at locations to be intersected by said object when moving in said path; and determining the times of intersection of each of said first, second, third and fourth detection lines by said object so as to provide information regarding the path and velocity of movement for said object, wherein each of said first, second, third and fourth detection lines is established by projecting a beam from one side boundary of said region and detecting said beam at the opposite side boundary of said region.

2. The method of claim 1 comprising the additional steps of:

comparing the times of intersection of said first and second detection lines by said moving object to provide information regarding the component of velocity of movement of the object in a direction perpendicular to said first and second detection lines;

determining from comparisons of the times of intersection of said third and fourth detection lines with the times of intersection with said first and second detection lines the slope of the movement path in relation to said first and second detection lines; and adjusting the difference between the intersection times of said first and second detection lines in accordance with said slope of the movement path to obtain information regarding the speed of object movement across the plane.

3. The method of claim 1, further including a determination of locations at which the object intersects detection lines which comprises measuring a first time interval between object detection along said first detection line and along said second detection line; measuring a second time interval between object detection along said first detection line and said third detection line; comparing said first and second time intervals to determine the distance to the right or left of the point of intersection of said first and third detection lines at which the object intersects said first detection line, and comparing the relative times of detection of said second and fourth lines to determine whether the point at which the object intersects said second detection line is to the right or left of the intersection of said second and fourth detection lines.

4. A device for diagnosing movement of an object in a plane comprising means providing a horizontally extending support surface having opposite side boundaries for support of said object during movement in said plane and between said side boundaries, first, second and third sensor means for detecting the intersection of said object with first, second and third linear and horizontal paths that are above said support surface and that are parallel to but spaced from each other in said plane, fourth, fifth and sixth sensor means for detecting the intersection of said object with fourth, fifth and sixth linear and horizontal paths that are above said support surface and that intersect, respectively, said first, second and third paths at an acute angle, and circuit means responsive to said sensor means for processing signals from said sensor means to develop electronic information indicative of the speed and path of movement of said object along said plane, each of said sensor means comprising emitter means on one side boundary of said support surface for projecting a horizontal beam across said surface and a detector for receiving said beam at the opposite side boundary of said surface and for developing a signal for application to said circuit means.

5. A game device comprising means providing a horizontally extending support surface having opposite side boundaries for support of an object which is propelled by a player to be moved in a horizontal plane and in a longitudinal direction between said side boundaries, first and second sensor means for detecting the intersection of said object with first and second horizontal and linear paths that are parallel to but spaced from each other in said plane, third and fourth sensor means for detecting the intersection of said object with third and fourth horizontal and linear paths intersection, respectively, said first and second paths at acute angles, circuit means responsive to said sensor means for processing signals from said sensor means to develop electronic signals which indicate the path of movement of said object along said plane, and display means responsive to said electronic signals from said circuit means for displaying a representation of said object moving in a path which corresponds to said indicated path of movement of said object.

6. A device according to claim 5 wherein said circuit means further processes signals from said sensor means to develop electronic signals which indicate object speed, and wherein the representation of said object displayed by said display means is moved at a speed proportions to the speed indicated by said electronic signals.

7. A method for obtaining and displaying information regarding the movement of an object propelled by a player of a game in a horizontal path through a region in adjacent parallel relation to a horizontal reference plane, comprising the steps of providing a horizontal object-supporting surface which defines said region and side boundaries of said region, establishing first, second, third and fourth horizontal detection lines extending through said region to be intersected by an object moving in said path, determining the relative times of intersection of each of said detection lines by said object to provide information regarding the path of movement and velocity of an object moving through said region, and displaying a representation of said object moving through a display region in a path which corresponds to said path of movement of said object along said horizontal reference plane.

8. A method as defined in claim 7, wherein said first and second lines are in spaced parallel relation, and wherein said third and fourth detection lines intersect said first and second lines at points along a reference line which is perpendicular to said first and second detection lines.

9. A method as defined in claim 7, further including the step of establishing at least one additional detection line extending through said region to be intersected by an object moving in said path, and determining the time of intersection of each said additional detection line in relation to the times of intersection with each of said first, second, third and fourth detection lines to provide additional information regarding said path of movement of said object.

10. A method as defined in claim 9, wherein said first and second lines are in spaced parallel relation, wherein said third and fourth detection lines intersect said first and second lines at points along a reference line which is perpendicular to said first and second detection lines, and wherein a fifth detection line extends through said region without intersecting any of said first, second, third and fourth detection lines.

11. A method as defined in claim 10, wherein said fifth line is in parallel relation to said first and second detection lines and wherein a sixth detection line is at an acute angle to and intersects said fifth detection line at a point along said reference line.

12. A game device for obtaining information regarding the movement of an object in a horizontal path through a region in adjacent parallel relation to a horizontal reference plane, comprising means providing a horizontally extending support surface having opposite side boundaries and defining said region for support of an object which is propelled by a player to be moved in a horizontal plane and in a longitudinal direction between said side boundaries, sensing means for developing signals in response to the intersection of an object moving in said path with first, second, third and fourth horizontal detection lines extending through said region, and time measuring means for determining the relative times of said signals to develop electronic signals corresponding to the path of movement and velocity of an object moving through said region, and display means responsive to said electronic signals from said time measuring means for displaying a representation of said object moving in a path which corresponds to said indicated path of movement of said object.

13. A device as defined in claim 12, wherein said first and second lines are in spaced parallel relation, and wherein said third and fourth detection lines intersect said first and second lines at points along a reference line which is perpendicular to said first and second detection lines.

14. A device as defined in claim 12, further including the means for developing a signal in response to the intersection of an object moving in said path with at least one additional detection line extending through said region, said time measuring means being operative to determine the time of intersection of each said additional signal in relation to the times of signals corresponding to intersections with said first, second, third and fourth detection lines to develop additional electronic signals corresponding to said path of movement of said object.

15. A method as defined in claim 14, wherein said first and second lines are in spaced parallel relation, wherein said third and fourth detection lines intersect said first and second lines at points along a reference line which is perpendicular to said first and second detection lines, and wherein a fifth detection line extends through said region in spaced relation each of said first, second, third and fourth detection lines.

16. A method as defined in claim 15, wherein said fifth line is in parallel relation to said first and second detection lines and wherein a sixth detection line is at an acute angle to and intersects said fifth detection line at a point along said reference line.

17. A method as defined in claim 16, wherein said display means is arranged to respond to said additional electronic signals to display a change of speed and a curvature of the path of said representation of said object.

18. A method as defined in claim 14, wherein said display means is arranged to respond to said additional electronic signals to display a change of speed of said representation of said object.

* * * * *